US006298831B1

(12) United States Patent
Rembold et al.

(10) Patent No.: US 6,298,831 B1
(45) Date of Patent: Oct. 9, 2001

(54) SYSTEM FOR OPERATING A FUEL SUPPLY SYSTEM FOR AN INTERNAL COMBUSTION ENGINE, IN PARTICULAR OF A MOTOR VEHICLE

(75) Inventors: Helmut Rembold, Stuttgart; Ferdinand Grob, Besigheim; Hartmut Bauer, Gerlingen; Uwe Maienberg, Stuttgart; Klaus Scherrbacher, Schwieberdingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/119,112

(22) Filed: Jul. 20, 1998

(30) Foreign Application Priority Data

Jul. 19, 1997 (DE) ..... 197 31 102

(51) Int. Cl.[7] ..... F02M 41/00

(52) U.S. Cl. ..... 123/497; 123/447; 123/506

(58) Field of Search ..... 123/495, 497, 123/506, 456, 447, 321, 322, 198 DB, 493

(56) References Cited

U.S. PATENT DOCUMENTS

| | | | | |
|---|---|---|---|---|
| 4,430,980 | * | 2/1984 | Pidgeon | 123/497 |
| 4,800,859 | * | 1/1989 | Sagisaka et al. | 123/497 |
| 5,016,181 | * | 5/1991 | Hayashida | 123/493 |
| 5,085,193 | * | 2/1992 | Morikawa | 123/497 |
| 5,237,975 | * | 8/1993 | Betki et al. | 123/497 |
| 5,284,119 | * | 2/1994 | Smitley | 123/497 |
| 5,379,737 | * | 1/1995 | Hu | 123/322 |
| 5,379,741 | * | 1/1995 | Matysiewicz et al. | 123/497 |
| 5,636,611 | * | 6/1997 | Frankle et al. | 123/322 |
| 5,735,242 | * | 4/1998 | Kahlenbeck et al. | 123/322 |
| 5,797,372 | * | 8/1998 | Sugimoto | 123/493 |

* cited by examiner

*Primary Examiner*—Thomas N. Moulis
(74) *Attorney, Agent, or Firm*—Kenyon & Kenyon

(57) ABSTRACT

A fuel supply system for an internal combustion engine, in particular of a motor vehicle, is equipped with a pressure accumulator and a high-pressure pump with which fuel can be delivered to the pressure accumulator. Also provided is a control device with which at least the pressure in the pressure accumulator can be controlled. When the internal combustion engine is in coastdown (overrun) mode, the pump output of the high-pressure pump can be reduced.

24 Claims, 1 Drawing Sheet

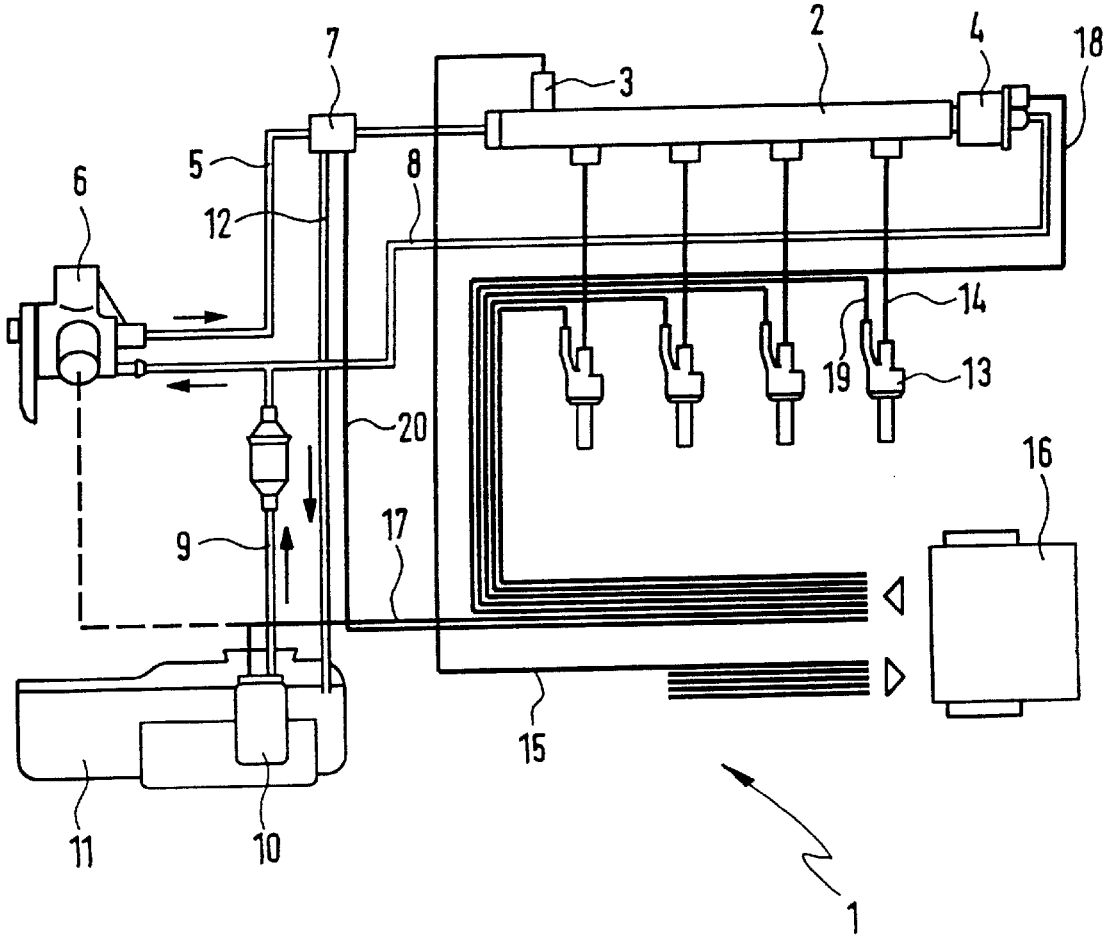
7
2
4
18
3
5
8
6
12
14
19
13
20
16
9
17
15
11
10
1

SYSTEM FOR OPERATING A FUEL SUPPLY SYSTEM FOR AN INTERNAL COMBUSTION ENGINE, IN PARTICULAR OF A MOTOR VEHICLE

FIELD OF THE INVENTION

The present invention relates to a method for operating a fuel supply system for an internal combustion engine, in particular of a motor vehicle, in which fuel is pumped by a pump into a pressure accumulator. The present invention also relates to a fuel supply system for an internal combustion engine, in particular of a motor vehicle, having a pressure accumulator and a pump with which fuel can be delivered to the pressure accumulator, and having a control device with which at least the pressure in the pressure accumulator can be controlled.

BACKGROUND INFORMATION

Continually increasing demands are being made on an internal combustion engine, for example of a motor vehicle, in terms of reduced fuel consumption and exhaust emissions, while greater output is also desired. To meet these demands, modern internal combustion engines are equipped with a fuel supply system in which the delivery of fuel into the combustion chamber of the internal combustion engine is controlled and/or regulated electronically, in particular by means of a computer-aided control device. It is possible in this context to inject the fuel into an air intake pipe of the internal combustion engine, or directly into the combustion chamber of the internal combustion engine.

With the latter method in particular, which is referred to as "direct injection," the fuel must be injected under pressure into the combustion chamber. Provided for this purpose is a pressure accumulator into which the fuel is pumped by means of a pump and subjected to a high pressure. From there the fuel is then injected through injection valves into the combustion chambers of the internal combustion engine.

A number of operating states can occur while the internal combustion engine is in operation. At full load, the internal combustion engine produces its maximum output; at part load it produces a desired portion thereof. At idle, the rotation speed of the internal combustion engine is as low as possible. And in coastdown (overrun) mode, the internal combustion engine generates no output, but instead creates a certain braking action.

Coastdown mode occurs, for example, when the motor vehicle is traveling down a sloping road and the driver of the motor vehicle removes his or her foot from the accelerator pedal. As a result, no further fuel is injected into the internal combustion engine, and often, in addition, no further air is delivered to the internal combustion engine. The injection valves thus remain closed during a coastdown period of this kind. Thus not only is the desired braking effect achieved, but also fuel is thereby saved.

SUMMARY OF THE INVENTION

It is an object of the present invention to further improve the coastdown (overrun) mode operating state.

This object is achieved according to the present invention, in the case of a method and a fuel supply system of the kind cited initially, in that when the internal combustion engine is in coastdown (overrun) mode, the pump output of the pump is or can be reduced.

Reduction of the pump output of the pump is equivalent to reducing the pump load. Since a considerable proportion of the pump output is converted into heat, the result is that the reduction in pump output causes less heat to be generated. The result of this in turn is that the fuel is heated less. This reduced heating of the fuel decreases the risk of vapor bubble formation, as well as the risk of misfiring or uneven operation of the internal combustion engine.

With a lower pump output, the pump is moreover under a lesser load than at a high pump output. This has advantageous effects in terms of lower wear and therefore a longer pump service life.

In an advantageous embodiment of the present invention, the pressure accumulator is closed off when the internal combustion engine is in coastdown mode. This represents a simple possibility for reducing the pump output of the pump. Closing off the pressure accumulator means that the pump no longer needs to generate the high pressure at which it supplies fuel to the pressure accumulator. The pump output required for the purpose is thus lower.

According to the present invention, the fuel pumped to the pressure accumulator is shunted off via a switchover valve. A switchover valve that can be switched by the control device is thus provided between the pump and the pressure accumulator. During coastdown periods, this switchover valve is switched over by the control device in such a way that the pressure accumulator is closed off. Fuel that continues to be pumped by the pump toward the pressure accumulator is then shunted off by the switchover valve in a different direction.

It is particularly advantageous if the shunted-off fuel is conveyed into a fuel tank or to the input of the pump. This results, without major effort, in fuel recirculation, so that the fuel can be re-used immediately.

According to the present invention, the pressure in the pressure accumulator is reduced when the internal combustion engine is in coastdown mode. For this purpose, the pressure accumulator is equipped with a pressure control valve that can be switched by the control device. Because of the lower pressure in the pressure accumulator, the pump needs to generate a lower pump output. The reduction in pressure in the pressure accumulator thus represents a simple means of reducing the pump output of the pump.

According to the present invention, the pressure in the pressure accumulator is kept approximately constant while the internal combustion engine is in coastdown mode. When the period of coastdown then comes to an end, the required pressure in the pressure accumulator is then immediately available, for example, to transition into a part-load operating condition. Maintaining a constant pressure in the pressure accumulator, according to the present invention, thus results in an immediate and, at the same time, smooth transition to other operating conditions. Another result of the approximately constant pressure in the pressure accumulator is to prevent vapor bubbles or the like from occurring in the pressure accumulator, particularly in coastdown mode.

BRIEF DESCRIPTION OF THE DRAWING

The FIGURE shows a schematic depiction of an exemplary embodiment of a fuel supply system according to the present invention.

DETAILED DESCRIPTION

The figure depicts a fuel supply system 1 which is provided for use in an internal combustion engine of a motor vehicle. Fuel supply system 1 is a so-called common rail system, which is used in particular in an internal combustion engine with direct injection.

Fuel supply system 1 has a pressure accumulator 2 which is equipped with a pressure sensor 3 and a pressure control valve 4. Pressure accumulator 2 is connected via a pressure line 5 to a high-pressure pump 6. Inserted into pressure line 5 is a switchover valve 7 which, in a normal state, connects high-pressure pump 6 to pressure accumulator 2. High-pressure pump 6 is connected via a pressure line 8 to pressure control valve 4. Via a pressure line 9 and a filter, pressure control valve 4 and therefore also high-pressure pump 6 are connected to a fuel pump 10 which is suitable for drawing in fuel from a fuel tank 11. Switchover valve 7 is connected via a line 12 to fuel tank 11. Alternatively, line 12 can also be connected on the intake side to high-pressure pump 6.

Fuel supply system 1 has four injection valves 13 which are connected via pressure lines 14 to pressure accumulator 2. Injection valves 13 are capable of injecting fuel into corresponding combustion chambers of the internal combustion engine, where the fuel is ignited by means of spark plugs.

By means of a signal line 15, pressure sensor 3 is connected to a control device 16 to which a plurality of other signal lines are also connected as input lines. Fuel pump 10 is connected by means of a signal line 17, and pressure control valve 4 by means of a signal line 18, to control device 16. Alternatively or additionally, high-pressure pump 6 can also be connected to control device 16. Injection valves 13 are also connected by means of signal lines 19 to control device 16. Lastly, switchover valve 7 is connected via a signal line 20 to control device 16.

Fuel is pumped by fuel pump 10 out of fuel tank 11 to high-pressure pump 6. High-pressure pump 6 generates in pressure accumulator 2 a pressure which is measured by pressure sensor 3 and can be set to a desired value by corresponding actuation of pressure control valve 4 and/or by controlling fuel pump 10 or high-pressure pump 6. The fuel is then injected through injection valves 13 into the combustion chamber of the internal combustion engine.

A factor for determining the quantity of fuel injected into the combustion chamber is the pressure in pressure accumulator 2. The greater the pressure in pressure accumulator 2, the more fuel will be injected into the combustion chamber during the same injection period. The aforesaid high pressure in pressure accumulator 2 is useful for achieving the full load required by the internal combustion engine.

When the internal combustion engine is in coastdown (overrun) mode, i.e., for example, when the motor vehicle is traveling down a sloping road and the driver removes his or her foot from the accelerator pedal, no fuel is injected into the internal combustion engine. Injection valves 13 are thus not activated by control device 16, and therefore remain closed.

Also in coastdown mode, pressure control valve 4 is closed by control device 16, and switchover valve 7 is switched over from its normal state into a shutoff state. In this shutoff state, high-pressure pump 6 is connected via switchover valve 7 to line 12, so that the fuel delivered by high-pressure pump 6 flows off into fuel tank 11.

Because injection valves 13 are closed, pressure control valve 4 is closed, and switchover valve 7 is in its shutoff state, pressure accumulator 2 is therefore closed off. No fuel is thus being removed from or delivered to pressure accumulator 2. The pressure in pressure accumulator 2 thus remains approximately constant.

The fuel delivered by high-pressure pump 6 is, as mentioned, shunted off into fuel tank 11. Since fuel tank 11 is essentially unpressurized, this means that high-pressure pump 6 no longer needs to work against the high pressure which is usually present in pressure accumulator 2. The pump output required for the purpose from high-pressure pump 6 is thus lower. The fact that fuel is shunted off via switchover valve 7 and line 12 into fuel tank 11 thus reduces the pump output of high-pressure pump 6.

When coastdown mode ends, switchover valve 7 is switched by control device 16 back into its normal state. Because pressure accumulator 2 was closed off during coastdown mode, and because the pressure in pressure accumulator 2 was thus approximately constant, sufficiently high pressure is available in pressure accumulator 2, immediately after coastdown mode ends, to again inject fuel via injection valves 13 into the internal combustion engine.

In an alternative embodiment of fuel supply system 1 depicted in the figure, switchover valve 7, line 12, and control line 20 are not present. Pressure line 5 thus constitutes a direct connection between high-pressure pump 6 and pressure accumulator 2.

When the internal combustion engine is in coastdown mode, the pressure in pressure accumulator 2 is reduced. This is achieved by appropriate activation, by control device 16, of pressure control valve 4 to cause it to open. The pressure in pressure accumulator 2 is then held approximately constant at a reduced value. This can be monitored by control device 16 by means of pressure sensor 3, and appropriately controlled and/or regulated by means of pressure control valve 4.

Because of the lower pressure in pressure accumulator 2, high-pressure pump 6 no longer needs to work against the high pressure which is usually present in pressure accumulator 2. The pump output required for the purpose from high-pressure pump 6 is thus lower. The reduction in the pressure in pressure accumulator 2 thus reduces the pump output of high-pressure pump 6.

When coastdown mode ends, pressure control valve 4 is switched by control device 16 into its closed state until the desired high pressure is once again present in pressure accumulator 2. At that time, at the latest, fuel can once again be injected via injection valves 13 into the internal combustion engine.

The alternative embodiment just described can also be carried out by achieving the reduced pressure in pressure accumulator 2 by correspondingly controlling and/or regulating fuel pump 10 so that the latter delivers less fuel to high-pressure pump 6, or, via control line 17 shown with dashed lines, by means of direct control and/or regulation of high-pressure pump 6.

What is claimed is:

1. A method for operating a fuel supply system for an internal combustion engine of a motor vehicle, comprising the steps of:

causing a high-pressure pump to pump fuel into a pressure accumulator; and reducing a pump output of the high-pressure pump when the internal combustion engine is in a coastdown mode.

2. The method according to claim 1, further comprising the step of closing off the pressure accumulator when the internal combustion engine is in the coastdown mode.

3. The method according to claim 2, further comprising the step of shunting off the fuel pumped to the pressure accumulator via a switchover valve.

4. The method according to claim 3, further comprising the step of conveying the shunted-off fuel into one of a fuel tank and the high-pressure pump.

5. The method according to claim 1, further comprising the step of reducing a pressure in the pressure accumulator when the internal combustion engine is in the coastdown mode.

6. The method according to claim 1, further comprising the step of maintaining a pressure in the pressure accumulator at an approximately constant level when the internal combustion engine is in the coastdown mode.

7. An electrical storage medium for a control device of an internal combustion engine of a motor vehicle, comprising:

a read-only memory for storing a program for execution on a computing device, wherein the program executes the steps of:

causing a high-pressure pump to pump fuel into a pressure accumulator, and reducing a pump output of the high-pressure pump when the internal combustion engine is in a coastdown mode.

8. The electrical storage medium according to claim 7, wherein the computing device includes a microprocessor.

9. A fuel supply system for an internal combustion engine of a motor vehicle, comprising:

a pressure accumulator;

a high-pressure pump for delivering fuel to the pressure accumulator; and a control device for controlling at least a pressure in the pressure accumulator, wherein a pump output of the high-pressure pump is reduced when the internal combustion engine is in a coastdown mode.

10. The fuel supply system according to claim 9, further comprising a pressure control valve coupled to the pressure accumulator and to the control device, wherein the control device switches the pressure control valve between an on state and an off state.

11. The fuel supply system according to claim 9, further comprising a switchover valve provided between the high-pressure pump and the pressure accumulator, wherein the control device switches the switchover valve between a normal state and a shutoff state.

12. A method for operating a fuel-supply device for use in an internal combustion engine, comprising the steps of:

pumping fuel by a high-pressure pump into an accumulator; and if the internal combustion engine is in a coastdown mode then reducing a pressure against which the high-pressure pump is operated.

13. The method according to claim 1, further comprising the steps of:

closing off the pressure accumulator when the internal combustion engine is in the coastdown mode; and conveying shunted-off fuel into one of a fuel tank and the high-pressure pump.

14. The method according to claim 5, further comprising the step of shunting off the fuel pumped to the pressure accumulator via a switchover valve.

15. The method according to claim 14, further comprising the step of conveying the shunted-off fuel into one of a fuel tank and the high-pressure pump.

16. The electrical storage medium according to claim 7, wherein the program further executes the steps of:

closing off the pressure accumulator when the internal combustion engine is in the coastdown mode; and causing a switchover valve to shunt off the fuel pumped to the pressure accumulator into one of a fuel tank and the high-pressure pump.

17. The fuel supply system according to claim 9, wherein the pressure accumulator is closeable when the internal combustion engine is in the coastdown mode.

18. The fuel supply system according to claim 9, further comprising a switchover valve for shunting off the fuel pumped to the pressure accumulator.

19. The fuel supply system according to claim 18, further comprising a conveying arrangement for conveying the shunted-off fuel into one of a fuel tank and the high-pressure pump.

20. The method according to claim 12, further comprising the step of closing off the accumulator when the internal combustion engine is in the coastdown mode.

21. The method according to claim 20, further comprising the step of shunting off the fuel pumped to the accumulator via a switchover valve.

22. The method according to claim 21, further comprising the step of conveying the shunted-off fuel into one of a fuel tank and the high-pressure pump.

23. The method according to claim 12, further comprising the step of reducing a pressure in the accumulator when the internal combustion engine is in the coastdown mode.

24. The method according to claim 12, further comprising the step of maintaining a pressure in the accumulator at an approximately constant level when the internal combustion engine is in the coastdown mode.

* * * * *